US010024029B1

(12) United States Patent
Ruiz

(10) Patent No.: US 10,024,029 B1
(45) Date of Patent: Jul. 17, 2018

(54) DEMOLITION SYSTEM

(71) Applicant: Jaime Ruiz, Ventura, CA (US)

(72) Inventor: Jaime Ruiz, Ventura, CA (US)

( * ) Notice: Subject to any disclaimer, the term of this patent is extended or adjusted under 35 U.S.C. 154(b) by 0 days.

(21) Appl. No.: 15/636,052

(22) Filed: Jun. 28, 2017

(51) Int. Cl.
*E02F 3/413* (2006.01)
*E02F 3/96* (2006.01)

(52) U.S. Cl.
CPC ..... *E02F 3/413* (2013.01); *E02F 3/962* (2013.01)

(58) Field of Classification Search
CPC ..... E02F 3/413; E02F 3/962
See application file for complete search history.

(56) References Cited

U.S. PATENT DOCUMENTS 2,969,966 A * 1/1961 Matheis ..... E01H 5/12 173/186
3,061,123 A * 10/1962 Rogers ..... E02F 3/30 37/404
3,097,439 A * 7/1963 Calkin ..... E02F 3/402 171/43
3,394,765 A * 7/1968 Davis ..... E02F 5/32 172/744
3,430,703 A * 3/1969 Richey ..... A01B 35/00 172/136
3,596,996 A * 8/1971 Carter ..... E02F 3/962 299/10
3,702,712 A * 11/1972 Cairns, III ..... E02F 3/962 299/26
3,778,111 A * 12/1973 Ciofani ..... E02F 3/962 299/36.1
4,038,766 A * 8/1977 Felstet ..... E02F 3/962 172/751
4,041,624 A * 8/1977 Fryrear ..... E02F 3/962 37/404
4,230,435 A * 10/1980 Azevedo ..... E02F 3/962 37/408
4,297,799 A * 11/1981 Sonerud ..... E02F 3/962 37/406
5,115,583 A * 5/1992 Vail ..... E02F 3/963 37/403
5,116,189 A * 5/1992 Shammout ..... B66F 9/065 37/403
5,197,212 A * 3/1993 Vail ..... E02F 3/963 37/379
5,456,028 A * 10/1995 Larson ..... E02F 3/962 172/699

(Continued)

FOREIGN PATENT DOCUMENTS

FR 2253882 A1 * 7/1975 ..... E02F 3/962
GB 1356808 A * 6/1974 ..... E02F 3/962

(Continued)

*Primary Examiner* — Jamie L McGowan

(57) ABSTRACT

A demolition system for equipping a skid steer to rip concrete and asphalt from the ground includes a bucket that is coupled to a tractor. The bucket has a rear wall and a bottom wall. A pair of blocks is provided and each of the blocks is coupled to the rear wall of the bucket. A pair of gripping units is provided and each of the gripping units is removably positioned in an associated one of the blocks. Moreover, each of the gripping units extends below the bottom wall of the bucket. Thus, each of the gripping units selectively engages an object on the ground thereby facilitating the object to be urged upwardly from the ground.

13 Claims, 4 Drawing Sheets

(56) References Cited

U.S. PATENT DOCUMENTS 6,023,863 A * 2/2000 Mahin ..... E02F 3/3609 37/404
6,099,008 A * 8/2000 Caffey ..... B62K 27/12 280/204
6,308,440 B1 * 10/2001 Mueller ..... A01B 59/062 37/302
6,311,417 B1 * 11/2001 Pratt ..... E02F 3/962 37/404
6,434,863 B1 * 8/2002 Meurer ..... E02F 3/401 37/410
6,490,815 B1 * 12/2002 Pratt ..... E02F 3/401 37/404
6,671,984 B2 * 1/2004 Larson ..... E02F 3/3604 37/404
6,764,139 B1 * 7/2004 Wortman ..... E01C 23/121 172/817
7,059,072 B2 * 6/2006 Archuleta, Jr. ..... E02F 3/40 299/26
7,086,184 B2 * 8/2006 Archuleta, Jr. ..... E02F 3/40 37/404
7,695,214 B2 4/2010 Mailand
7,739,815 B2 * 6/2010 Horton ..... E02F 3/8152 37/404
8,112,913 B2 * 2/2012 Sirr ..... E02F 3/404 37/379
8,752,643 B2 * 6/2014 Shekleton ..... E02F 3/627 172/677
D726,774 S * 4/2015 Polumati ..... D15/27
2003/0167661 A1 * 9/2003 Larson ..... E02F 3/3604 37/404

FOREIGN PATENT DOCUMENTS

JP 2004011289 A * 1/2004 ..... E02F 3/401
WO WO2016010516 1/2016

* cited by examiner

DEMOLITION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to demolition devices and more particularly pertains to a new demolition device for equipping a skid steer to rip concrete and asphalt from the ground.

BRIEF SUMMARY OF THE INVENTION

An embodiment of the disclosure meets the needs presented above by generally comprising a bucket that is coupled to a tractor. The bucket has a rear wall and a bottom wall. A pair of blocks is provided and each of the blocks is coupled to the rear wall of the bucket. A pair of gripping units is provided and each of the gripping units is removably positioned in an associated one of the blocks. Moreover, each of the gripping units extends below the bottom wall of the bucket. Thus, each of the gripping units selectively engages an object on the ground thereby facilitating the object to be urged upwardly from the ground.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
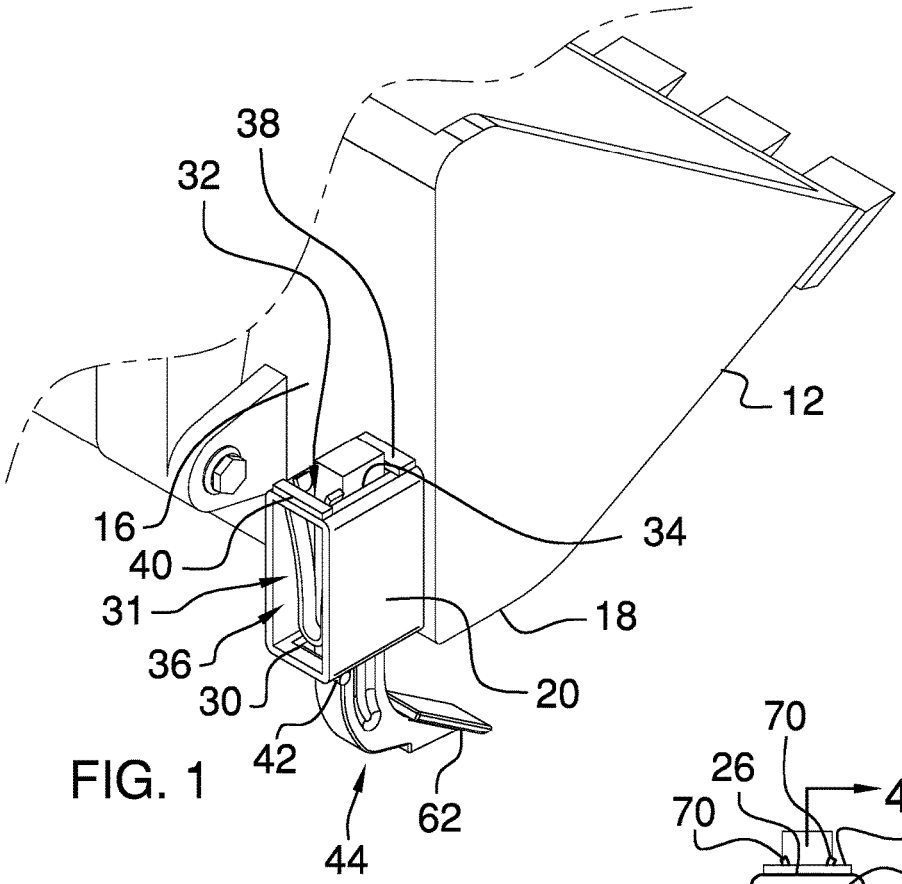
FIG. 1 is a back perspective view of a demolition system according to an embodiment of the disclosure.
Figure 2:
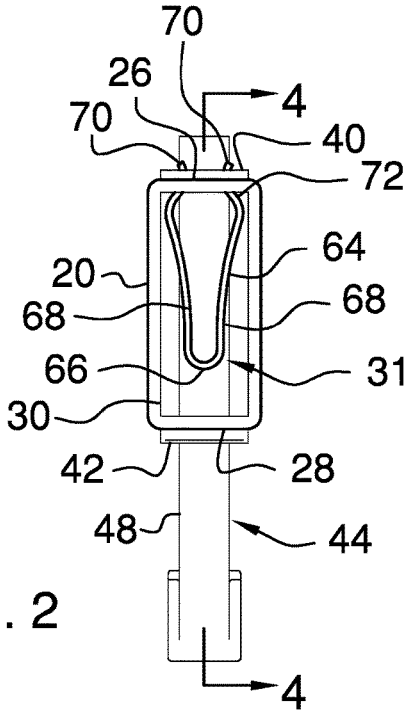
FIG. 2 is a back view of block and a gripping unit of an embodiment of the disclosure.
Figure 3:
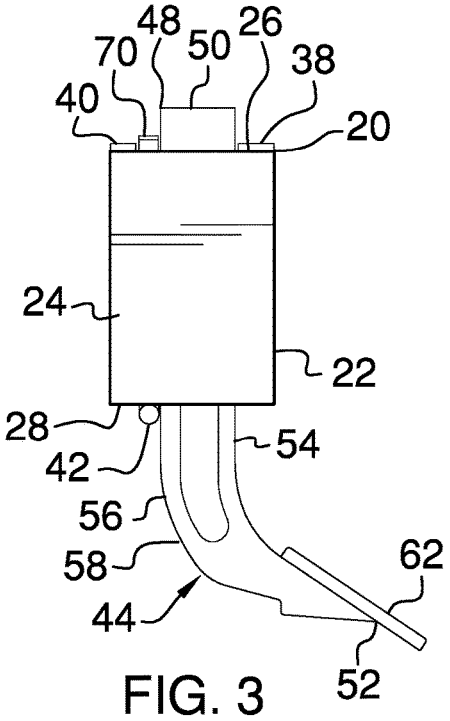
FIG. 3 is a right side view of block and a gripping unit of an embodiment of the disclosure.
Figure 4:
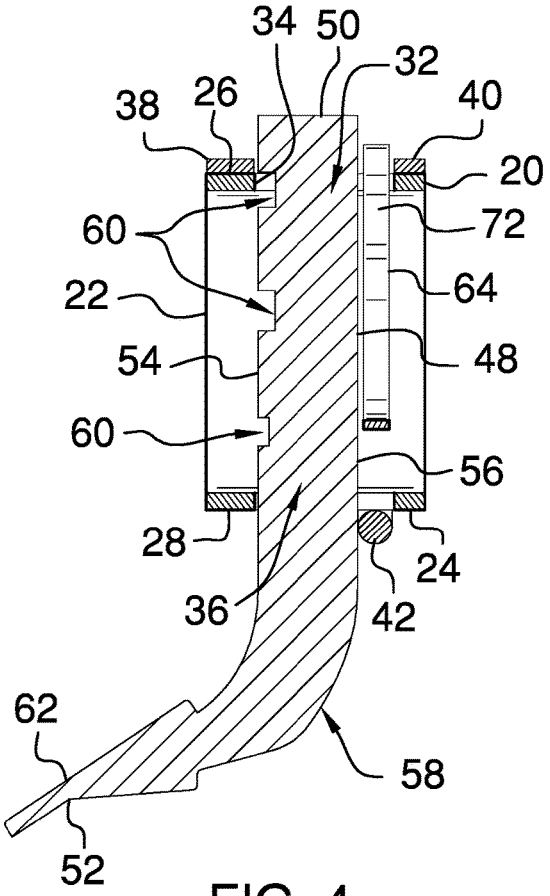
FIG. 4 is a cross sectional view taken along line 4-4 of FIG. 2 of an embodiment of the disclosure.
Figure 5:
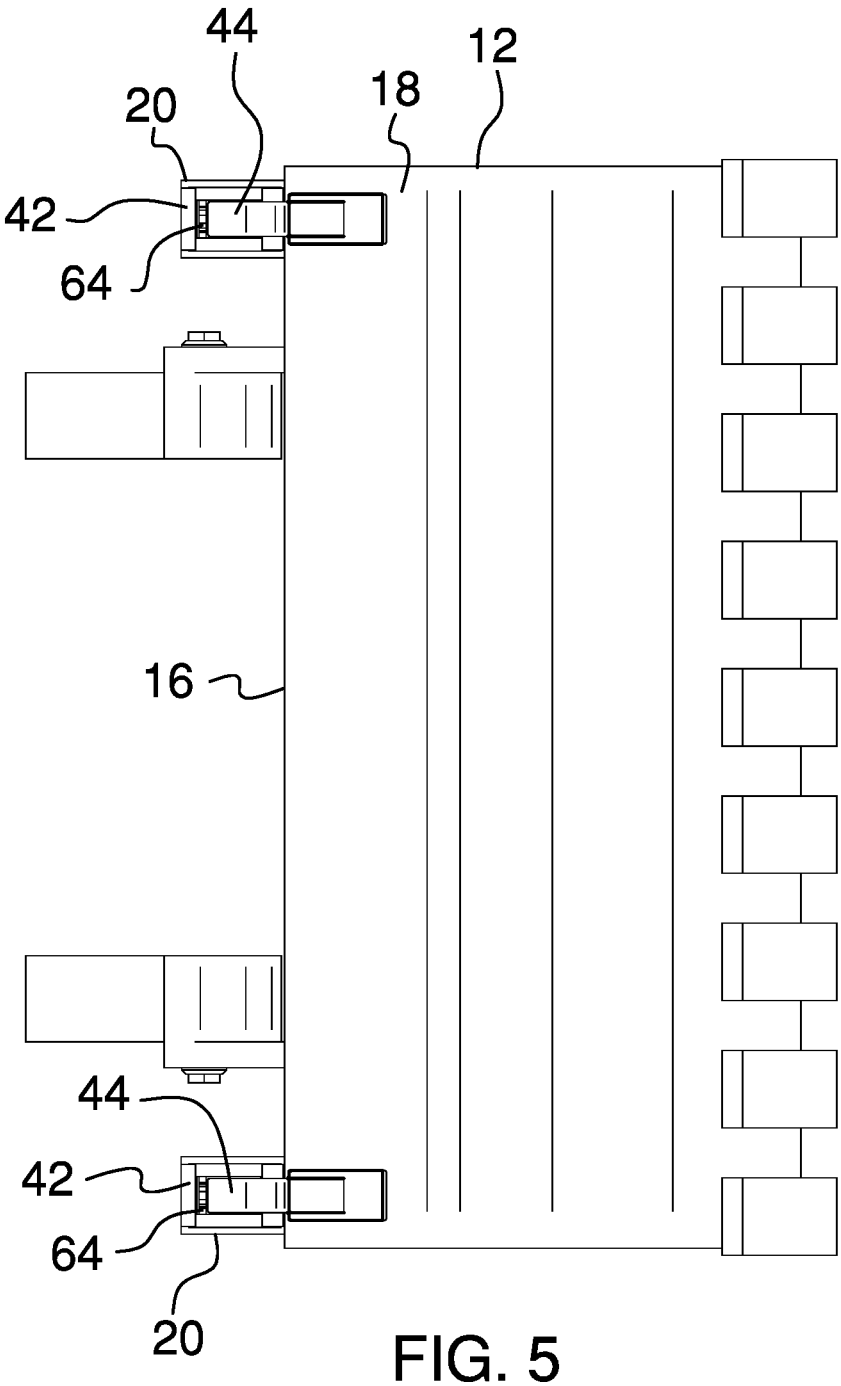
FIG. 5 is a bottom view of an embodiment of the disclosure.
Figure 6:
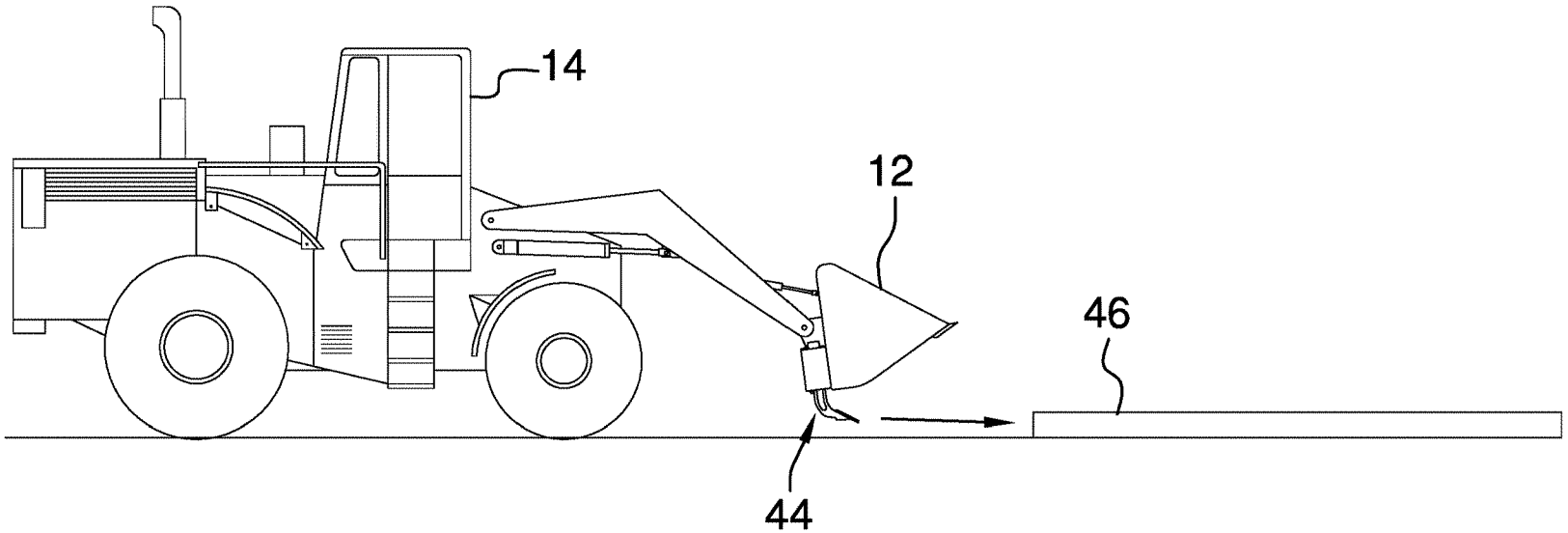
FIG. 6 is a perspective in-use view of an embodiment of the disclosure.

With reference now to the drawings, and in particular to FIGS. 1 through 6 thereof, a new demolition device embodying the principles and concepts of an embodiment of the disclosure and generally designated by the reference numeral 10 will be described.

As best illustrated in FIGS. 1 through 6, the demolition system 10 generally comprises a bucket 12 that is coupled to a tractor 14. The bucket 12 has a rear wall 16 and a bottom wall 18 and the tractor 14 may be a skid steer or the like. The bucket 12 may be a dirt bucket 12 of any conventional design for mounting on a skid steer.

A pair of blocks 20 is provided and each of the blocks 20 is coupled to the rear wall 16 of the bucket 12. Each of the blocks 20 has a basal wall 22 and a perimeter wall 24 extending away therefrom. The perimeter wall 24 corresponding to each of the blocks 20 has a top side 26 and a bottom side 28. The basal wall 22 corresponding to each of the blocks 20 is coupled to the rear wall 16 of the bucket 12. Moreover, the bottom side 28 of the corresponding block 20 is aligned with the bottom wall 18 of the bucket 12.

The perimeter wall 24 corresponding to each of the blocks 20 has a distal edge 30 with respect to the basal wall 22 to define an opening 31 into the corresponding block 20. The top side 26 corresponding to each of the blocks 20 has a first aperture 32 extending therethrough and the first aperture 32 has a bounding edge 34. The bottom side 28 corresponding to each of the blocks 20 has a second aperture 36 extending therethrough and the second aperture 36 is aligned with the first aperture 32.

A pair of first members 38 is provided and each of the first members 38 is coupled to the top side 26 of an associated one of the blocks 20. Each of the first members 38 is positioned between the first aperture 32 of the associated block 20 and the rear wall 16 of the bucket 12. A pair of second members 40 is provided and each of the second members 40 is coupled to the top side 26 of an associated one of the blocks 20. Each of the second members 40 is positioned between the first aperture 32 of the associated block 20 and the distal edge 30 of the associated block 20. A pair of rods 42 is provided and each of the rods 42 is coupled to the bottom side 28 of an associated one of the blocks 20. Moreover, each of the rods 42 extends laterally across the second aperture 36 in the associated block 20. The rod 42 is positioned closer to the distal edge 30 of the associated block 20 than the basal wall 22 of the associated block 20.

A pair of gripping units 44 is provided and each of the gripping units 44 is removably positioned in an associated one of the blocks 20. Additionally, each of the gripping units 44 extends below the bottom wall 18 of the bucket 12. In this way each of the gripping units 44 selectively engages an object 46 on the ground when the bucket 12 is manipulate with hydraulics on the tractor 14. The object 46 may be a concrete pad, an asphalt pad and any other resilient, planar object 46 that is to be demolished. The gripping units 44 facilitate the tractor 14 to remove the object 46 from the ground that the tractor 14 would otherwise be incapable of removing.

Each of the gripping units 44 comprises a third member 48 that has a primary end 50, a secondary end 52, a front side 54 and a back side 56. The third member 48 includes a bend 58 that is positioned closer to the secondary end 52 than the primary end 50 such that the third member 48 has a J-shape. The front side 54 has a plurality of slots 60 extending toward the back side 56. The slots 60 are spaced apart from each other and are distributed between the primary end 50 and the bend 58.

The third member 48 is extended upwardly through each of the first 32 and second 36 apertures in the associated block 20. Moreover, a selected one of the slots 60 receives the first member on the associated block 20. In this way the secondary end 52 of the third member 48 is spaced a selected distance from the bottom wall 18 of the bucket 12. The secondary end 52 tapers to a point and the secondary end 52 is directed forwardly along the bottom side 28 of the bucket 12 when the third member 48 is positioned in the associated block 20. A plate 62 is coupled to the front side 54 of the third member 48. The plate 62 is aligned with the secondary end 52 to frictionally engage the object 46 thereby facilitating the object 46 to be manipulated.

A pair of locks 64 is provided and each of the locks 64 is removably coupled between an associated one of the gripping units 44 and an associated one of the blocks 20. Each of the locks 64 retains the associated gripping unit 44 in the associated block 20. Each of the locks 64 has a central portion 66 extending between a pair of end portions 68. Moreover, the end portions 68 corresponding to each of the locks 64 is spaced apart from each other such that each of the locks 64 has a U-shape. Each of the end portions 68 has a distal end 70 with respect to the central portion 66 and each of the end portions 68 undulates between the central portion 66 and the corresponding distal end 70. The distal end 70 of each of the end portions 68 is directed outwardly from each other to define a curve 72 that engages the bounding edge 34 of the first aperture 32 in the associated block 20. In this way each of the locks 64 is retained in the associated block 20.

Each of the locks 64 is inserted into the first aperture 32 in the associated block 20 and each of the locks 64 is positioned between the back side 56 of the associated gripping unit and the bounding edge 34 of the first aperture 32. In this way the selected slot 60 on the associated gripping unit 44 is inhibited from disengaging from the first member on the associated block 20. Additionally, each of the locks 64 extends downwardly along the back side 56 of the associated third member 48 when the locks 64 are positioned in the associated block 20. Each of the end portions 68 corresponding to each of the locks 64 is biased apart from each other to frictionally engage the bounding edge 34 of the first aperture 32 in the associated block 20. In this way each of the locks 64 is inhibited from being removed from the first aperture 32 in the associated block 20.

The back side 56 corresponding to each of the third members 48 abuts the rod 42 on the associated block 20. Thus, the secondary 52 end corresponding to each of the third members 48 is inhibited from being urged rearwardly along the bucket 12 when the plate 62 on each of the third members 48 engages the object 46. Thus, the rod 42 and the lock 64 corresponding to each of the blocks 20 inhibits the associated third member 48 from being urged rearwardly in the associated block 20.

In use, the third member 48 corresponding to each of the gripping units 44 is slid upwardly through the second 36 and first 32 apertures in the associated block 20. Additionally, the selected slot on the third member 48 is positioned to engage the first member on the associated block 20. In this way the secondary end 52 of the third member 48 is spaced a selected distance from the bottom wall 18 of the bucket 12. The end portions 68 of a selected lock 64 are urged together and the selected lock 64 is extended downwardly in the first aperture 32. The end portions 68 of the selected lock 64 are released thereby facilitating the curve on each of the end portions 68 to engage the bounding edge 34 of the first aperture 32 in the associated block 20. In this way the selected lock 64 and the corresponding third member 48 are retained in the associated block 20. The bucket 12 is manipulated with hydraulics on the tractor 14 to facilitate the plate 62 on each of the third members 48 to engage the object 46 on the ground thereby facilitating the tractor 14 to remove the object 46 from the ground.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A demolition system comprising:

a bucket being configured to be coupled to a tractor, said bucket having a rear wall and a bottom wall;

a pair of blocks, each of said blocks being coupled to said rear wall of said bucket, each of said blocks having a basal wall and a perimeter wall extending away therefrom, said perimeter wall corresponding to each of said blocks having a top side and a bottom side, said basal wall corresponding to each of said blocks being coupled to said rear wall of said bucket having said bottom side of said corresponding block being aligned with said bottom wall of said bucket, said top side corresponding to each of said blocks having a first aperture extending therethrough, said first aperture having a bounding edge;

a pair of gripping units, each of said gripping units being removably positioned in an associated one of said blocks, each of said gripping units extending below said bottom wall of said bucket wherein each of said gripping units is configured to selectively engage an object on the ground thereby facilitating the object to be urged upwardly from the ground; and a pair of first members, each of said first members being coupled to said top side of an associated one of said blocks, each of said first members being positioned between said first aperture of said associated block and said rear wall of said bucket.

2. The system according to claim 1, wherein said perimeter wall corresponding to each of said blocks having a distal edge with respect to said basal wall to define an opening into said corresponding block.

3. The system according to claim 2, wherein said bottom side corresponding to each of said blocks having a second aperture extending therethrough.

4. The system according to claim 1, further comprising a pair of second members, each of said second members being coupled to said top side of an associated one of said blocks, each of said second members being positioned between said first aperture of said associated block and said distal edge of said associated block.

5. The system according to claim 3, further comprising a pair of rods, each of said rods being coupled to said bottom side of an associated one of said blocks, each of said rods laterally extending across said second aperture in said associated block, said rod being positioned closer to said distal edge of said associated block than said basal wall of said associated block.

6. The system according to claim 4, wherein each of said gripping units comprises a third member having a primary end, a secondary end, a front side and a back side, said third member having a bend being positioned closer to said secondary end than said primary end such that said third member has a J-shape, said secondary end tapering to a point.

7. The system according to claim 6, wherein said front side has a plurality of slots extending toward the back side, said slots being spaced apart from each other and being distributed between said primary end and said bend.

8. The system according to claim 7, further comprising:

a pair of first members each being coupled to an associated one of said blocks; and said third member is extended upwardly through each of said first and second apertures in said associated block having a selected one of said slots receiving said first member on said associated block such that said secondary end of said third member is spaced a selected distance from said bottom wall of said bucket.

9. The system according to claim 6, further comprising a plate being coupled to said front side of said third member, said plate being aligned with said secondary end wherein said plate is configured to frictionally engage the object thereby facilitating the object to be manipulated.

10. The system according to claim 1, further comprising a pair of locks, each of said locks being removably coupled between said an associated one of said gripping units and an associated one of said blocks to retain said associated gripping unit in said associated block.

11. The system according to claim 10, wherein each of said locks has a central portion extending between a pair of end portions, said end portions corresponding to each of said locks being spaced apart from each other such that each of said locks has a U-shape.

12. The system according to claim 11, wherein:

each of said blocks has a first aperture, said first aperture in each of said blocks having a bounding edge;

a pair of first members, each of said first members being coupled to an associated one of said blocks;

each of said gripping units has a plurality of slots; and each of said locks is inserted into said first aperture in said associated block having each of said locks being positioned between a back side of said associated gripping unit and said bounding edge of said first aperture such that said selected slot on said associated gripping member is inhibited from disengaging from said first member on said associated block, each of said end portions corresponding to each of said locks being biased apart from each other to frictionally engage said bounding surface of said first aperture in said associated block.

13. A demolition system comprising:

a bucket being configured to be coupled to a tractor, said bucket having a rear wall and a bottom wall;

a pair of blocks, each of said blocks being coupled to said rear wall of said bucket, each of said blocks having a basal wall and a perimeter wall extending away therefrom, said perimeter wall corresponding to each of said blocks having a top side and a bottom side, said basal wall corresponding to each of said blocks being coupled to said rear wall of said bucket having said bottom side of said corresponding block being aligned with said bottom wall of said bucket, said perimeter wall corresponding to each of said blocks having a distal edge with respect to said basal wall to define an opening into said corresponding block, said top side corresponding to each of said blocks having a first aperture extending therethrough, said first aperture having a bounding edge, said bottom side corresponding to each of said blocks having a second aperture extending therethrough;

a pair of first members, each of said first members being coupled to said top side of an associated one of said blocks, each of said first members being positioned between said first aperture of said associated block and said rear wall of said bucket;

a pair of second members, each of said second members being coupled to said top side of an associated one of said blocks, each of said second members being positioned between said first aperture of said associated block and said distal edge of said associated block;

a pair of rods, each of said rods being coupled to said bottom side of an associated one of said blocks, each of said rods laterally extending across said second aperture in said associated block, said rod being positioned closer to said distal edge of said associated block than said basal wall of said associated block;

a pair of gripping units, each of said gripping units being removably positioned in an associated one of said blocks, each of said gripping units extending below said bottom wall of said bucket wherein each of said gripping units is configured to selectively engage an object on the ground thereby facilitating the object to be urged upwardly from the ground, each of said gripping units comprising:

a third member having a primary end, a secondary end, a front side and a back side, said third member having a bend being positioned closer to said secondary end than said primary end such that said third member has a J-shape, said front side having a plurality of slots extending toward the back side, said slots being spaced apart from each other and being distributed between said primary end and said bend, said third member being extended upwardly through each of said first and second apertures in said associated block having a selected one of said slots receiving said first member on said associated block such that said secondary end of said third member is spaced a selected distance from said bottom wall of said bucket, said secondary end tapering to a point, and a plate being coupled to said front side of said third member, said plate being aligned with said secondary end wherein said plate is configured to frictionally engage the object thereby facilitating the object to be manipulated; and a pair of locks, each of said locks being removably coupled between said an associated one of said gripping units and an associated one of said blocks to retain said associated gripping unit in said associated block, each of said locks having a central portion extending between a pair of end portions, said end portions corresponding to each of said locks being spaced apart from each other such that each of said locks has a U-shape, each of said locks being inserted into said first aperture in said associated block having each of said locks being positioned between said back side of said associated gripping unit and said bounding edge of said first aperture such that said selected slot on said associated gripping member is inhibited from disengaging from said first member on said associated block, each of said end portions corresponding to each of said locks being biased apart from each other to frictionally engage said bounding surface of said first aperture in said associated block.

* * * * *